US007279014B2

(12) United States Patent
Rusk

(10) Patent No.: US 7,279,014 B2
(45) Date of Patent: Oct. 9, 2007

(54) METHODS FOR COLORING TEXTILES

(75) Inventor: John Rusk, Powder Springs, GA (US)

(73) Assignee: Gagwear, Inc., Norcross, GA (US)

( * ) Notice: Subject to any disclaimer, the term of this patent is extended or adjusted under 35 U.S.C. 154(b) by 0 days.

(21) Appl. No.: 10/752,320

(22) Filed: Jan. 6, 2004

(65) Prior Publication Data

US 2005/0144742 A1 Jul. 7, 2005

(51) Int. Cl.
*D06P 3/872* (2006.01)

(52) U.S. Cl. ..... 8/529; 8/532; 8/533; 8/549; 8/637.1

(58) Field of Classification Search ..... 8/531, 8/532, 529, 533, 549, 637.1
See application file for complete search history.

(56) References Cited

U.S. PATENT DOCUMENTS 3,127,231 A * 3/1964 Neale ..... 8/630
3,460,336 A * 8/1969 Demas et al. ..... 57/245
4,082,502 A * 4/1978 VON DER Eltz et al. ..... 8/476
5,019,133 A * 5/1991 Himeno et al. ..... 8/531
5,131,914 A * 7/1992 Kelley ..... 8/449
5,174,791 A * 12/1992 Buhler et al. ..... 8/532
5,693,103 A * 12/1997 Van Chambers et al. ..... 8/532
5,707,858 A * 1/1998 Screws et al. ..... 435/263
2003/0056301 A1* 3/2003 Dekker et al. ..... 8/158

OTHER PUBLICATIONS

Trotman, Dyeing and Chemical Technology of Textile Fibres, 6th ed 1985 pp. 508-509.*

* cited by examiner

*Primary Examiner*—Lorna M. Douyon
*Assistant Examiner*—Amina Khan
(74) *Attorney, Agent, or Firm*—James W. Kayden; Thomas, Kayden, Horstemeyer & Risley, LLP

(57) ABSTRACT

Systems and methods for coloring an article having a polyester portion and at least one portion of a second material where the polyester portion and second material are not blended together in the article. The entire article is dyed a first color, after which the first color is removed from the second material using a post reduction clear process. The entire article is then dyed a second color, which is not absorbed by the polyester portion. The system and process permit the creation of prepared for dye articles having a polyester portion of one color and a portion of a second material that is a different color.

3 Claims, 3 Drawing Sheets

METHODS FOR COLORING TEXTILES

FIELD OF THE INVENTION

The present invention generally relates to textile manufacturing, and more specifically, to systems and methods for producing a multicolored article by dyeing the article two or more times.

BACKGROUND OF THE INVENTION

Textiles are typically manufactured by either fabricating a textile product and subsequently coloring it or by coloring fibers or yarns and subsequently fabricating a colored textile product. Often two manufacturers are required to create a finished textile product, where one manufacturer fabricates the colored or uncolored textile product and a separate manufacturer dyes the fibers, yarns and/or fabricated textile products.

Prepared for dye (PFD) products are textile fabrications that have been sewn into a completed product but have not yet undergone the dyeing process. Typically, PFD apparel products include 100% cotton or cotton rich fabrications and sewing threads. Cotton fabrications are preferred because cotton has been and remains a stable and cost effective product. Because of the popularity of PFD cotton fabrications, manufacturers that dye PFD products have focused on methods for dyeing cotton or cotton rich fabrications. Other methods for dyeing articles having alternative fabrications have not been the focus of manufacturers because cotton readily accepts dyes at atmospheric conditions, thus making cotton fabrications simple to dye.

PFD products are advantageous because they allow a dye house to maintain in inventory a single non-colored product and dye the product in any quantity requested by a customer. Additionally, PFD products are advantageous because they can be dyed and shipped to a customer in a very short time frame. The main disadvantage of PFD products until now is that they can only be dyed solid colors. Because of the market for colorful and stylish garments, textile manufacturers have struggled to find ways for producing multicolored and patterned articles.

One challenge to textile manufacturers is the coloring of articles having multiple materials, such as a mixture of natural and synthetic materials (e.g., cotton and polyester materials). Prior art methods have attempted to dye such articles using a variety of methods. For instance, U.S. Pat. No. 3,767,356 to Turner discloses a process for dyeing polyester-cellulose union materials in a single bath containing a mixture of disperse and reactive dyes. U.S. Pat. No. 6,068,666 to Amick et al. discloses a process for over-dyeing a blended fiber garment. While these processes address the need to dye articles including multiple materials, they do not address the need to create articles having multiple colors and/or patterns.

Textile manufacturers are faced with the challenge of producing multicolored, patterned articles in order for these articles to appeal to consumers. A common method that is currently used to create an article having more than one color is to cut pieces of previously dyed fabrics and sew the colored fabric pieces together to create the article. The colored fabric can be formed by dyeing yarn before knitting it into fabric or by dyeing the fabric after knitting. This "cut and sew" process requires a consumer of the raw yarn or fabric to purchase a large quantity of the exact same article to make the process cost effective due to the amount of fiber or fabric that must be dyed in a single run. Consequently, a consumer who desires a small number of multicolored articles must either pay an excessive sum for these articles or purchase a larger quantity of articles than he desires.

The "cut & sew" process also requires a manufacturer to maintain a large inventory of dyed fabrics. A large inventory requires a large financial outlay and involves an increased financial risk in the event of a catastrophe that damages or destroys the inventory. Additionally, the "cut and sew" process can lead to large quantities of obsolete inventory if certain colorways do not sell. Furthermore, this process results in a large amount of dyed fabric wastage. The dyed fabric is cut into pieces to produce a textile fabrication and the leftover fabric is discarded. Since this fabric has already been dyed, not only is fabric wasted, but the dye used to color this fabric is also wasted.

Accordingly, what is needed are systems and methods for producing PFD products having multiple colors and/or a variety of patterns.

BRIEF SUMMARY OF THE INVENTION

Briefly stated, the present invention provides systems and methods for producing multicolored articles. More specifically, a PFD article having polyester portions and portions of another material is dyed a first color using a pressurized dye vessel. The article is then treated with chemicals to remove the first color dye from the non-polyester portions of the article. The article is then dyed a second color, however, the second color dye only adheres to or is absorbed by the non-polyester portions of the article. Thus, a multicolored article is created. This process may be repeated a third or more times until the desired effect is achieved. The invention provides the ability to produce articles in a variety of colors and patterns.

According to one embodiment of the present invention, there is disclosed a process for coloring an article. The process includes the steps of providing an article having at least one polyester portion and at least one portion of a second material, where the second material has non-polyester portions, dyeing the article a first color, removing the first color from the non-polyester portions of the article, and dyeing the article a second color.

According to one aspect of the invention, the at least one portion of a second material may include cotton, rayon, nylon and/or a cotton/polyester blend. According to another aspect of the present invention, the first color is removed from the non-polyester portions of the article using sodium hydroxide and sodium hydrosulfide.

According to yet another aspect of the invention, the article may be dyed a first color inside a pressurized dye vessel and the article may be dyed a second color inside a standard cotton dye vessel. Furthermore, the article may be dyed a first color at a temperature of approximately 225-265° F. and the article may be dyed a second color at a temperature of approximately 140-200° F.

The article may be dyed a first color using a disperse dye, and may be dyed a second color using a reactive dye, a direct dye, or a pigment dye. The reactive dye may be a monochlorotrazine reactive dye.

According to another aspect of the invention, the process may further include rinsing the article with water after dyeing the article a first color. According to yet another aspect of the invention, the process may further include enzyming the article with a cellulase enzyme after dyeing the article a second color. The process may also include applying silicon to the article after enzyming the article with a cellulase enzyme.

According to another embodiment of the invention, there is disclosed an article coloring system including a first vessel, a first container of dye in communication with the first vessel, a second vessel, a container of chemicals in communication with the second vessel, and a second container of dye in communication with the second vessel. The first vessel is operable to receive an article having at least one polyester portion and at least one portion of another material. The first vessel is further operable to receive a first color. dye from the first container of dye in order to dye the article a first color. The second vessel is operable to receive the dyed article from the first vessel. The second vessel is further operable to receive chemicals from the container of chemicals in order to remove the first-color dye from the non-polyester portions of the dyed article. Additionally, the second vessel is operable to receive a second color dye from the second container of dye in order to dye the article a second color.

According to one aspect of the invention, the first vessel is pressurized and the second vessel is a standard cotton dye vessel. According to another aspect of the invention, the first vessel may operate at a temperature of approximately 225-265° F. and the second vessel may operate at a temperature of approximately 140-200° F.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
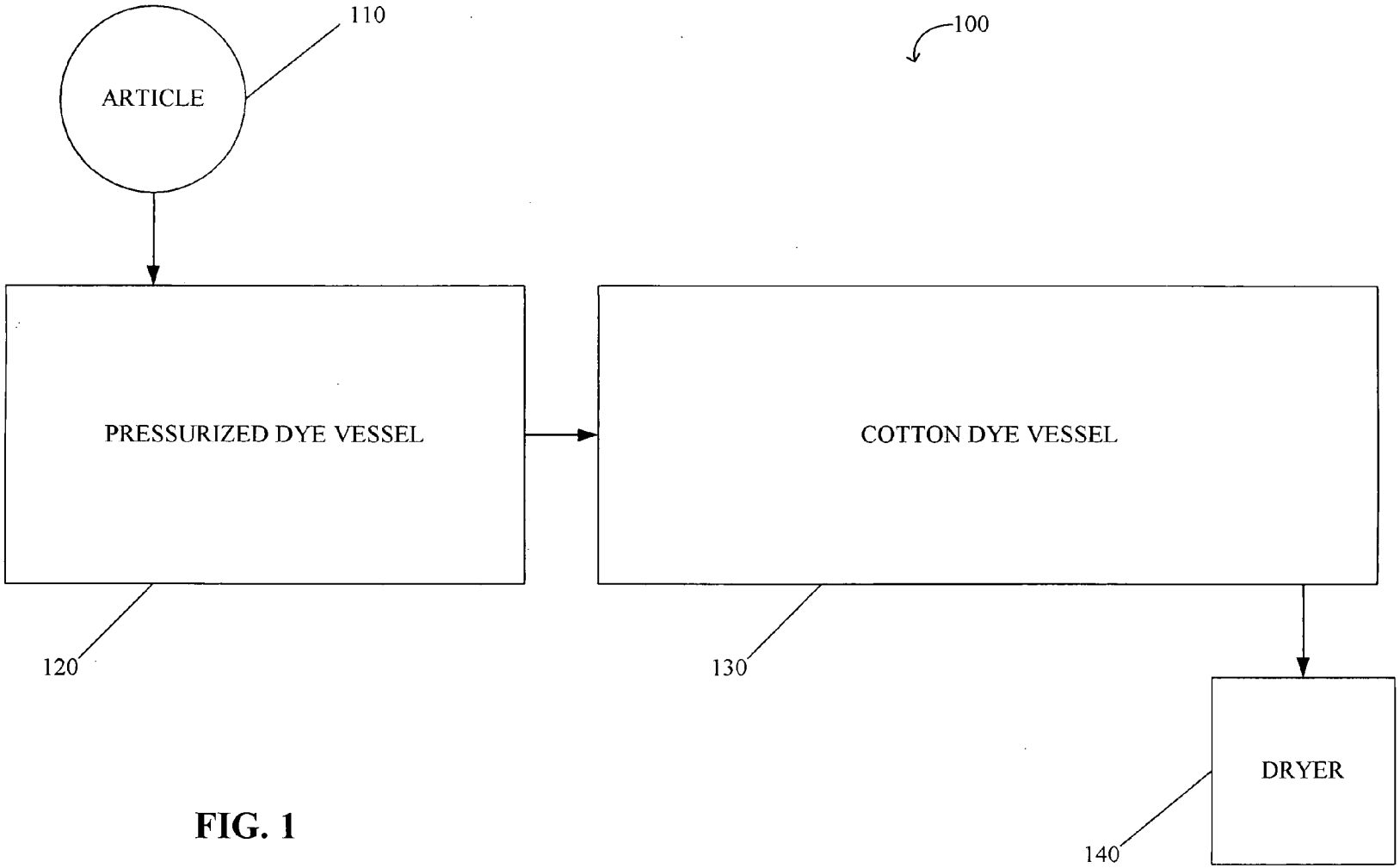
FIG. 1 shows a system diagram for applying color to an article, according to one embodiment of the present invention.

FIG. 1 shows a block diagram system 100 for applying color to an article 110, according to one embodiment of the present invention. The system generally includes a pressurized atmospheric dye vessel 120 and a standard cotton dye vessel 130. As illustrated, the pressurized dye vessel 120 and cotton dye vessel 130 are successively used to color the article 110.

More specifically, the pressurized dye vessel 120 is a large sealed container in which one or more articles, such as garments, may be placed. The pressure within the pressurized dye vessel 120 may be varied and is either manually controlled by a system operator or by an automated pressure control system, as is well known in the art. The temperature within the pressurized dye vessel 120 may also be controlled manually or by an automated temperature control system, as is well known in the art.

The cotton dye vessel 130 is also a large sealed container in which one or more articles 110 may be placed; however, this vessel operates under atmospheric conditions and much lower temperatures.

As is also shown in FIG. 1, the system 100 further includes a dryer 140. The dryer, as is well known to those of skill in the art, is provided for drying the article 110 after it has been dyed using the pressure dye vessel 120 and the cotton dye vessel 130.

As explained in greater detail below with respect to FIG. 2, the article 110 has at least one polyester portion and at least one portion of a second material. According to one aspect of the present invention, the second material may be cotton, rayon, nylon, or a cotton/polyester blend. The second material has non-polyester portions. It will be appreciated by one of ordinary skill in the art that other materials having low dyeing temperatures can alternatively be used for the second material in the article. In the article of the present invention, pieces of 100% polyester fabric may be sewn to pieces of 100% cotton, 100% rayon, or 100% nylon fabrics to create a patterned article. Alternatively, the article of the present invention may be knitted with 100% polyester portions as well as cotton/polyester blended portions in a pattern. For example, the article can be knitted with 100% polyester stripes alternated with cotton/polyester blended stripes. Either way, the 100% polyester portions and the cotton, rayon, nylon, or cotton/polyester blend portions are side by side in the article and not blended together. It will be appreciated by one of ordinary skill in the art that the article 110 can be constructed of two or more different fabrications or of two or more like fabrications that have been treated differently to have varying affinities for dye. It will also be appreciated by one of ordinary skill in the art that the article can be dyed using various dye processes take advantage of the various dye affinities of the fabrications within the article as well as the capabilities of the dye vessels. The article 110 can be a garment or any other type of textile product.

Figure 2:
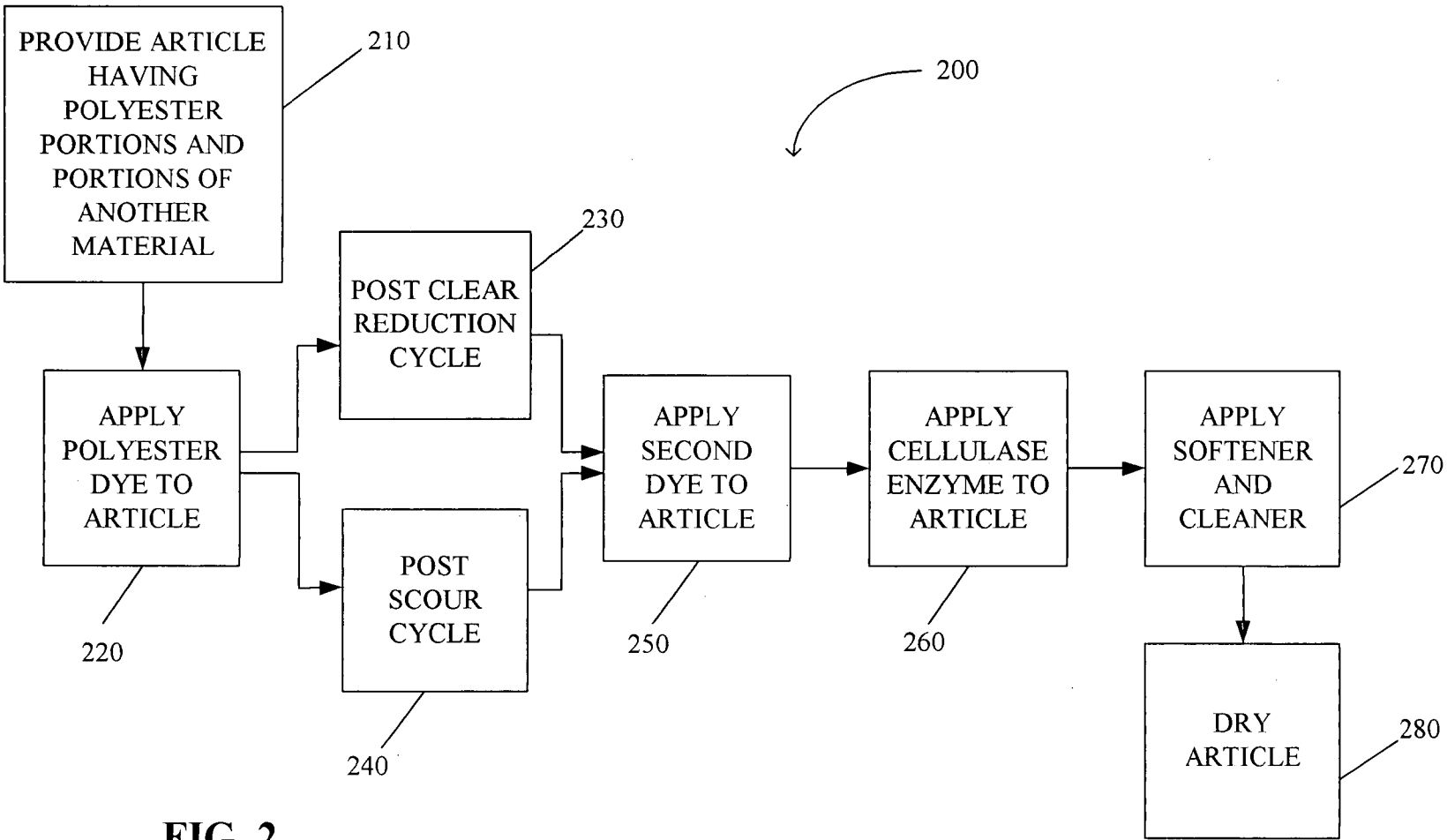
FIG. 2 shows a process flow diagram for applying color to an article, according to one embodiment of the present invention.

Referring now to FIG. 2, to create a multicolored article, the article 220 is first inserted into the pressurized dye vessel 120. According to one aspect of the present invention, the pressurized dye vessel 120 may be a custom made MCS Pressure Dyeing Machine. Water at approximately 120° F. is then added to the pressurized dye vessel 120. Preferably, approximately twelve pounds of water per pound of articles is added to the vessel, although it will be appreciated that different water ratios may be used to achieve the effects described herein. The pressurized dye vessel 120 creates agitation by rotating at approximately 12-15 revolutions per minute. During this agitation phase, a leveling agent is added to adjust the pH of the water. The leveling agent of choice is Burcotex RB, preferably in the amount of 1% of the volume weight, 2% of Burcolube SSC and 4% of acetic acid 20%. It will be appreciated that materials having similar properties may be substituted for one or more of these materials, in varying concentrations, as will be appreciated by one of ordinary skill in the art. The pressurized dye vessel 120 continues to rotate for a period of approximately 5 minutes.

After this 5 minute period of rotation, the polyester dye 220 of a first color is added to the pressurized dye vessel 120, preferably electronically, over a period of time, preferably 10 minutes. Alternatively, the polyester dye 220 can be manually added to the pressurized dye vessel 120. In the present invention, the polyester dye 220 of choice is a disperse dye. Following the addition of the polyester dye 220, the temperature in the pressurized dye vessel 120 is raised to approximately 265° F. at a rate of about 6° F. per minute and an internal pressure of 25 pounds per square inch (psi) is achieved. The article 210 remains in the pressurized vessel 120 at a temperature of 265° F. and pressure of 25 psi for approximately 25 minutes. Next, the temperature in the pressurized dye vessel 120 is reduced to approximately 160° F. at a rate of about 6° F. per minute. The water and chemicals are then drained from the pressurized vessel 120 over a period of time, preferably 10 minutes.

Following the draining process, the pressurized dye vessel 120 is filled with water at a temperature of approximately 120° F. to achieve a ratio of approximately twelve pounds of water per pound of articles. The pressurized vessel 120 is then agitated at about 12-15 rpm for approximately 10 minutes to rinse the excess chemicals, water and dyestuff from the article 210. After rinsing, the pressurized vessel 120 is drained and the article 210 is manually extracted from the vessel 120.

After the article 210 is extracted from the pressurized vessel 120, the article 210 is inserted into a standard cotton atmospheric dye vessel 130. According to one aspect of the present invention, the cotton dye vessel 130 may be a Braun TDL-600 or a Washex open pocket rotary machine. After the article 210 is inserted into the cotton dye vessel 130, the vessel 130 is filled with water at a temperature of approximately 90° F. to achieve a liquor ratio of twelve pounds of water per one pound of articles.

If the non-polyester portions of the article 210 are to be dyed a lighter color than the 100% polyester portions in the article 210, then the article 110 goes through a post clear reduction cycle 230. In this cycle 230, caustic and hydro chemicals are added to the water in the vessel 130 while it is agitated at approximately 12-15 rpm. According to one aspect of the present invention, the caustic and hydro chemicals are approximately 4% of a caustic alkali-Sodium Hydroxide and approximately 6% of Sodium Hydrosulfide. The temperature in the vessel 130 is then raised to approximately 200° F. at a rate of about 8° F. per minute. The article 210 remains in the vessel 130 at a temperature of 200° F. for approximately 15 minutes, and then the vessel 130 is drained. The vessel 130 is then filled with water at a temperature of approximately 130° F. to obtain a liquor ratio of about fifteen pounds of water per pound of articles. The vessel 130 is agitated at 12-15 rpm while 3% Acetic Acid 20 and 0.05% Sodium Meta-Bisulfite are added. The vessel 130 runs for approximately 10 minutes and then it is drained. This process 230 cleans the polyester dye stain off of the non-polyester portions of the article 210 and brings the pH level down to 7.0.

If the non-polyester portions of the article are to be dyed a darker color than the 100% polyester portions in the article 210, then the article 210 first goes through a post scour cycle 240 rather than the post clear reduction cycle 230. This process 240 removes the excess knitting oils and unwanted chemicals from the surface of the article 210. In the post scour cycle 240, the scour is added electronically to the cotton vessel 130, which is agitated at 12-15 rpm while the temperature is raised to 160° F. at a rate of 8° F. per minute. According to one embodiment of the present invention, the scour is comprised of 2% soda ash and 2% Burcoscour TX199. The vessel 130 is then drained. The vessel 130 is refilled with water at a temperature of approximately 120° F. to a liquor ratio of fifteen pounds of water per pound of articles to perform a five minute rinse cycle and then the vessel 130 is drained.

After the post clear reduction cycle 230 or the post scour cycle 240 is run on the articles 210, the non-polyester portions of the article 210 are ready to be dyed. The vessel 130 is filled with water at a temperature of 100° F. to a liquor ratio of 12 pounds of water per pound of articles. Sodium sulfate 40-100 grams per liter is then manually added to the vessel 130. Next, 2% of Burcoscour TX199 and 2% of Burcolube KRI are electronically added to the vessel 130 while it is agitated at 12-15 rpm. The Burcolube KRI is a lubricant that reduces the level of friction and the resulting pilling effect on the polyester or synthetic portions of the articles caused by abrasion in the vessel 130. A second dye 250 in a second color is then added electronically to the vessel 130 over a 10 minute period while the vessel 130 is agitated at 12-15 rpm. According to one embodiment of the present invention, the second dye 250 may be a reactive dye, a direct dye, or a pigment dye. According to another embodiment of the present invention, the reactive dye may be a monochlorotrazine (MCT) reactive dye. The temperature in the vessel 130 is raised to 150° F. at a rate of 3° F. per minute, at which point 4-10 grams per liter of soda ash is added to the vessel 130 over a 20 minute period. This raises the pH levels to 10.5-11.0 and allows the dyes to adhere to or be absorbed by the non-polyester portions of the article 210. The vessel 130 is then run for 30 minutes and drained. It is refilled with water at a temperature of 120° F. in a liquor ratio of fifteen pounds of water per one pound of articles, rinses for five minutes at approximately 12-15 rpm, and is drained again. The vessel 130 is then refilled with water at a temperature of 140° F. in a liquor ratio of fifteen pounds of water per one pound of articles and 2% of Burcoscour TX199 is added to the vessel 130 while the temperature is raised to approximately 190° F. at a rate of about 8° F. per minute. The vessel 130 is agitated at approximately 12-15 rpm for a period of time, preferably 10 minutes, and then is drained. The vessel 130 is then refilled with water at a temperature of 120° F. in a liquor ratio of fifteen pounds of water per one pound of articles and agitated for 5 minutes at approximately 12-15 rpm and once again drained.

Following the dyeing of the non-polyester portions of the articles 210, the articles are manually extracted from the cotton dye vessel 130 and manually inserted into a dryer 140. Articles having colored non-polyester portions are dried, step 280, at approximately 150° F. for about 45 minutes while articles having white non-polyester portions are dried, step 280, at approximately 120° F. for about 60 minutes.

In an alternate embodiment of the present invention, the article undergoes an enzyme process 260 following the dyeing of the non-polyester portions of the article and before the article is dried in step 280. In the enzyme process 260, the vessel 130 is refilled with water at approximately 140° F. in a liquor ratio of twelve pounds of water per one pound of articles and a cellulase enzyme is added to the vessel 130. According to one aspect of the present invention, the cellulase enzyme is 0.75% of Acetic Acid 20 and 0.91% of Quickstone LRA. The vessel 130 is then agitated at 12-15 rpm for about 10 minutes and then drained. This process 260 cleans the pilling off of the article 210 and creates a softer hand. This process 260 is optional, however, if it is omitted, the article may be less soft and may have surface pilling.

In another alternate embodiment of the present invention, the article undergoes a softening and cleaning process 270 following the enzyme process 260 and before the article is dried in step 280. In the softening and cleaning process 270, the vessel 130 is refilled with water at 125° F. in a liquor ratio of twelve pounds of water per one pound of articles and a combination of cationic and silicon softener is added to the vessel 130. According to one aspect of the present invention, the combination of cationic and silicon softener may be 0.05% of Acetic Acid 20 and 4% of Burcosoft AFK-4 and 2% Burcosoft SI-188. The vessel 130 is then agitated at approximately 12-15 rpm for a period of time, preferably 10 minutes, and then drained. This process 270 is also optional, however, if it is omitted, the article may be less soft.

Figure 3:
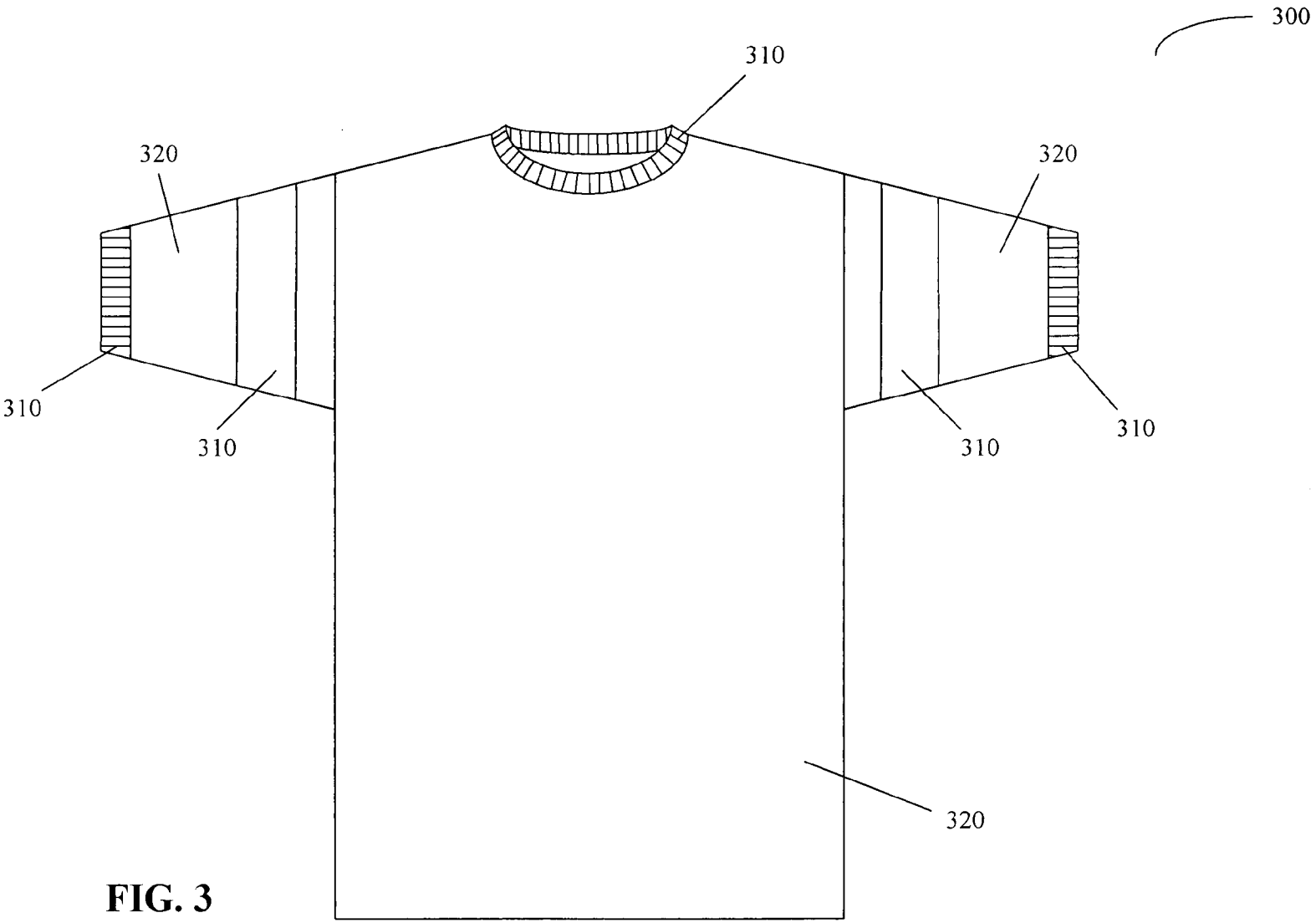
FIG. 3 is an illustrative example of a patterned article created using a dyeing process according to one embodiment of the present invention.

FIG. 3 is an illustrative example of a patterned article created using the dyeing process of the present invention. The garment 300 has 100% polyester portions 310 and 100% cotton portions 320 and is solid white. In this example, the garment 300 is inserted into a pressurized dye vessel and dyed navy blue using a disperse dye in the manner described above. The garment 300 is then inserted into a standard cotton dye vessel where it undergoes a post clear reduction cycle to remove the navy blue dye from the cotton portions 320 of the garment. After this cycle is completed, the polyester portions 310 of the garment are navy blue while the cotton portions 320 of the garment are white. While still in the cotton dye vessel, the garment is dyed yellow using a reactive dye in the manner described above. The reactive dye adheres only to the cotton portions 320 of the garment, therefore, the garment now has navy blue polyester portions 310 and yellow cotton portions 320. The garment undergoes an enzyme process and a softening and cleaning process so that it is softer and does not have surface pilling. Finally, the garment is removed from the cotton dye vessel and inserted into a dryer where it is dried.

In another alternate embodiment of the present invention, the polyester dye application 220 and the post clear reduction cycle 230 or post scour cycle 240 both take place while the article 210 is in the pressurized dye vessel 120. After the post clear reduction cycle 230 or post scour cycle 240, the article 210 is removed from the pressurized dye vessel 120 and inserted into the standard cotton dye vessel 130. The second dye application 250, enzyme application 260, and softening and cleaning process 270 are carried out as described above in the standard cotton dye vessel 130.

According to another alternate embodiment of the present invention, the polyester dye application 220, post clear reduction cycle 230 or post scour cycle 240, second dye application 250, enzyme application 260 and softening and cleaning process 270 all take place in the pressurized dye vessel 120.

In yet another alternate embodiment of the present invention, a cationic finish is applied to portions of the article 210 before it is dyed. The article 210 then undergoes the polyester dye application 220 in the pressurized vessel 120, and the post clear reduction cycle 230 or post scour cycle 240, the second dye application 250, the enzyme application, and the softening and cleaning process in the cotton vessel 130. The cationic finish affects the rate at which the dyes are accepted by the article, and thus a three or more color article may be created.

In another alternate embodiment of the present invention, an article is provided that has cationic polyester portions and portions of a second material. The article 210 then undergoes the polyester dye application 220, the post clear reduction cycle 230 or post scour cycle 240, the second dye application 250, the enzyme application 260, and the softening and cleaning process in the cotton vessel 130. The cationic polyester is able to accept the polyester dye at atmospheric conditions, therefore, the entire process can take place in the cotton vessel 130.

According to yet another alternate embodiment of the present invention, an article is provided that has polyester portions, portions of a second material, and portions of one or more other materials. The portions of the second material and other materials must l 5 have non-polyester portions. The article undergoes the polyester dye application in the pressurized vessel and the post reduction clear cycle or post scour cycle and second dye application in the cotton vessel. Before the article undergoes the enzyming process and the softening and cleaning process, it undergoes at least one additional dye application. The successive dye application(s) utilize a dye or dyes for the other material portions of the article. The finished article includes three or more materials that are each dyed a different color.

In another example, referring to the garment shown in FIG. 3, if the polyester components were instead a cationic polyester formulation and the cotton body components were composed of nylon, a multi-colored garment can be produced according to the present invention, but at atmospheric dye conditions. This takes advantage of the pressure vessel capabilities and the various dye characteristics of different fabrications and finishes. PFD garments can be constructed of multiple fabrications or pieced together goods or like fabrications treated differently to have varying affinities for dyestuffs.

In yet another alternate embodiment of the present invention, an article is provided that has polyester portions, and portions of a second material. The second material is a cotton/polyester blended material. The article may be knitted with stripes of polyester stripes alternating with stripes of the cotton/polyester blend material or in another pattern. Alternatively, the article may be fabricated with pieces of polyester sewn to pieces of a cotton/polyester blended material. The article undergoes the polyester dye application, the post reduction clear cycle or the post scour cycle, and the second dye application. The cotton/polyester blended portions of the finished article have a "heathered" appearance due to the cotton portion of the blend being a different color than the polyester portion of the blend.

Many modifications and other embodiments of the inventions set forth herein will come to mind to one skilled in the art to which these inventions pertain having the benefit of the teachings presented in the foregoing descriptions and the associated drawings. Thus, it will be appreciated by those of ordinary skill in the art that the present invention may be embodied in many forms and should not be limited to the embodiments described above. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A process for coloring an article consisting of:

providing an article having at least one polyester portion and at least one portion of a second material, wherein the at least one portion of the second material has at least one non-polyester portion;

applying a polyester dye to the article;

subjecting the article to a post clear reduction cycle or a post scour cycle;

applying a second dye to the article;

applying a cellulase enzyme to the article;

applying softener and cleaner to the article; and drying the article.

2. The process of claim 1, wherein the second dye is selected from the group of dyes consisting of reactive dye, pigment dye, and direct dye.

3. The process of claim 1, wherein the second dye is a monochlorotrazine reactive dye.

* * * * *